US011833638B2

(12) United States Patent
McCormick et al.

(10) Patent No.: US 11,833,638 B2
(45) Date of Patent: Dec. 5, 2023

(54) CMP POLISHING PAD WITH POLISHING ELEMENTS ON SUPPORTS

(71) Applicant: Rohm and Haas Electronic Materials CMP Holdings, Inc., Newark, DE (US)

(72) Inventors: John R. McCormick, Exton, PA (US); Bryan E. Barton, Lincoln University, PA (US)

(73) Assignee: Rohm and Haas Electronic Materials Holding, Inc., Newark, DE (US)

( * ) Notice: Subject to any disclaimer, the term of this patent is extended or adjusted under 35 U.S.C. 154(b) by 471 days.

(21) Appl. No.: 16/829,046

(22) Filed: Mar. 25, 2020

(65) Prior Publication Data

US 2021/0299817 A1 Sep. 30, 2021

(51) Int. Cl.
*B24B 37/26* (2012.01)
*B24B 37/22* (2012.01)

(52) U.S. Cl.
CPC ..... *B24B 37/26* (2013.01); *B24B 37/22* (2013.01)

(58) Field of Classification Search
CPC ..... B24B 37/20; B24B 37/24; B24B 37/245; B24B 37/26; B24B 39/06; B24B 39/065; B24B 21/04; B24D 7/063; B24D 3/007; B24D 3/20–26; B24D 3/346
USPC ... 451/41, 66, 287, 526, 527, 532, 533, 544, 451/921
See application file for complete search history.

(56) References Cited

U.S. PATENT DOCUMENTS 5,441,598 A * 8/1995 Yu ..... B24B 37/26 438/692
6,776,699 B2 8/2004 Amano et al.
6,817,925 B2 11/2004 Saigo et al.
6,817,926 B2 * 11/2004 Kollodge ..... B24B 37/04 451/63
7,226,345 B1 6/2007 Dornfeld et al.
7,517,277 B2 4/2009 Muldowney
7,771,251 B2 8/2010 Muldowney
7,828,634 B2 11/2010 Jiang et al.
9,649,742 B2 5/2017 Lefevre et al.
9,707,663 B2 * 7/2017 Shiro ..... B24B 37/24
2014/0273777 A1 9/2014 Lefevre et al.
2017/0095903 A1 * 4/2017 Galpin ..... B24B 37/20
2018/0086957 A1 * 3/2018 Sahlin ..... B24D 5/12
2019/0009458 A1 1/2019 Li et al.

FOREIGN PATENT DOCUMENTS

CN 201910627047 9/2019

* cited by examiner

*Primary Examiner* — Lee D Wilson
*Assistant Examiner* — Robert F Neibaur
(74) *Attorney, Agent, or Firm* — John J. Piskorski; Blake T. Biederman

(57) ABSTRACT

A polishing pad useful in chemical mechanical polishing can comprise a base pad having a top surface and surface, a plurality of polishing elements each having a top polishing surface and a bottom surface, and wherein each of the plurality of polishing elements is connected to the top surface of the base pad to the polishing element by three or more supports wherein the bottom surface of the polishing element, the top surface of the base pad and the supports define a region comprising at least one void and there are openings between the three or more supports. Such pad can be used in a method by providing a substrate and polishing the substrate with the pad, optionally, with a polishing medium.

4 Claims, 4 Drawing Sheets

CMP POLISHING PAD WITH POLISHING ELEMENTS ON SUPPORTS

FIELD OF THE INVENTION

The present invention relates generally to the field of polishing pads for chemical mechanical polishing. In particular, the present invention is directed to a chemical mechanical polishing pad having a polishing structure useful for chemical mechanical polishing of magnetic, optical and semiconductor substrates, including front end of line (FEOL) or back end of line (BEOL) processing of memory and logic integrated circuits.

BACKGROUND

In the fabrication of integrated circuits and other electronic devices, multiple layers of conducting, semiconducting and dielectric materials are deposited onto and partially or selectively removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical deposition (ECD), among others. Common removal techniques include wet and dry isotropic and anisotropic etching, among others.

As layers of materials are sequentially deposited and removed, the uppermost surface of the wafer becomes non-planar. Because subsequent semiconductor processing (e.g., photolithography, metallization, etc.) requires the wafer to have a flat surface, the wafer needs to be planarized. Planarization is useful for removing undesired surface topography and surface defects, such as rough surfaces, agglomerated materials, crystal lattice damage, scratches and contaminated layers or materials. In addition, in damascene processes a material is deposited to fill recessed areas created by patterned etching but the filling step can be imprecise and overfilling is preferable to underfilling of the recesses. Thus, material outside the recesses needs to be removed.

Chemical mechanical planarization, or chemical mechanical polishing (CMP), is a common technique used to planarize or polish workpieces such as semiconductor wafers and to remove excess material in damascene processes. In conventional CMP, a wafer carrier, or polishing head, is mounted on a carrier assembly. The polishing head holds the wafer and positions the wafer in contact with a polishing surface of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer traverses a typically annular polishing track, or polishing region, wherein the wafer's surface directly confronts the polishing layer. The wafer surface is polished and made planar by chemical and mechanical action of the polishing surface and polishing medium (e.g., slurry) on the surface.

The interaction among polishing layers, polishing media and wafer surfaces during CMP has been the subject of increasing study, analysis, and advanced numerical modeling in the past years in an effort to optimize polishing pad designs. Most of the polishing pad developments since the inception of CMP as a semiconductor manufacturing process have been empirical in nature, involving trials of many different porous and non-porous polymeric materials and mechanical properties of such materials. Some approaches involve providing a polishing pad with various protruding structures extending from the base of the pad—See, e.g. U.S. Pat. Nos. 6,817,925; 7,226,345; 7,517,277; 9,649,742; US Pat. Pub. No. 2014/0273777; U.S. Pat. No. 6,776,699. Other approaches use lattice structures that can form a generally monolithic structure having voids. See e.g. U.S. Pat. Nos. 7,828,634, 7,517,277; or 7,771,251. CN Pat. Pub. No. 110253423 A discloses a polishing structure with recess portions and protrusions that are hollow where the hollow region can be opened up by removal of the top surface of the protrusion during polishing.

U.S. Pat. Pub. No. 2019/0009458 discloses use of additive manufacturing (i.e. 3D printing) to make complex single unitary structures such as those having (a) a body portion having a surface portion thereon; (b) at least a first array of feature elements formed on said surface portion, each of said feature elements comprising: (i) a support structure connected to said surface portion and extending upward therefrom; and (ii) a top segment connected to said support structure, said top structure and said support structure together defining an internal cavity formed therein. These structures are disclosed as collapsing under pressure and then returning to previous configuration. The structure is disclosed as useful for noise and/or vibration isolation and skin body contact applications.

SUMMARY OF THE INVENTION

Disclosed herein is a base pad having a top surface and surface, a plurality of discrete polishing elements each having a top polishing surface and a bottom surface, wherein each of the plurality of polishing elements is connected to the top surface of the base pad to the polishing element by three or more supports wherein the supports are spaced apart (i.e. separated) from each other at the polishing element and at the base pad, and wherein the bottom surface of the polishing element, the top surface of the base pad and the supports define a region comprising at least one void and there are openings between the three or more supports.

Also disclosed herein is a method comprising providing a substrate, polishing the substrate using a polishing slurry and a pad wherein the pad comprises a base pad having a top surface and surface, a plurality of discrete polishing elements each having a top polishing surface and a bottom surface, wherein each of the plurality of polishing elements is connected to the top surface of the base pad to the polishing element by three or more supports wherein the supports are spaced apart (i.e. separated) from each other at the polishing element and at the base pad, and wherein the bottom surface of the polishing element, the top surface of the base pad and the supports define a region comprising at least one void, wherein the top polishing surface is contacted with the substrate during polishing.

DETAILED DESCRIPTION OF THE INVENTION

Figure 1:
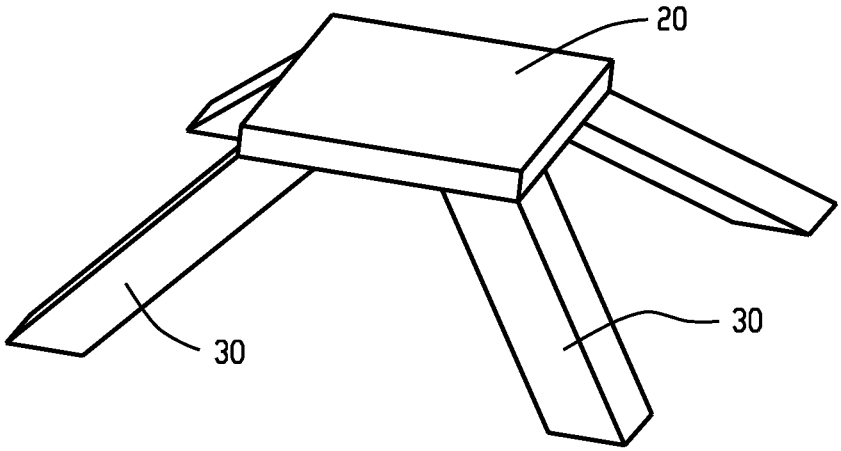
FIG. 1 is drawing of an example of a polishing element and supports as can be used in the pad of this invention.

The method and polishing pad as disclosed herein can provide certain advantages. Specifically, the design of the polishing pad can provide a relatively high surface polishing surface area (also referred to as contact area as this is the portion of the pad that contacts the surface to be polished) while the void(s) enable good management/transport of polishing fluids that are typically used. This fluid management feature can help control temperature—e.g. reducing or limiting the increase in temperature due to frictional heating during polishing. The lower polishing temperatures can help preserve mechanical properties of the polishing pad and can help avoid irreversible thermally induced chemical reactions in the pad or the substrate being polished. Chemical reactions in the pad can increase the likelihood of defect generations during polishing.

The pads as disclosed herein, having supports and a void, can enable having a pad having a polishing portion that can align with the surface of the substrate that is being polished for the entire length scale of the polishing portion of the pad. In other words, having individual polishing elements on supports can provide compliance such that the polishing portion of the pad (the combined polishing elements) are consistently in contact with the surface being polished.

The pad as disclosed herein can also provide harder or higher modulus top polishing surface (i.e. the polishing element) to be applied to the substrate to be polished while having a lower overall compressive modulus that can improve conformation of the pad to the substrate to be polished. For example, if the supports and the polishing element and base pad are made of the same material having a bulk modulus, the pad can have an effective modulus (e.g. stress applied/compression distance) that is less than the bulk modulus. For example, the effective compressive modulus of the pad can a be at least 0.1, at least 1, at least 10%, at least 20% or at least 25% of the bulk modulus of the material and up to 100, up to 90, up to 80, up to 70, up to 60, up to 50 or up to 40% of the bulk modulus of the material. The effective compressive modulus of the pad can be determined using a modified version of ASTM D3574 wherein since the specified thickness of 0.49 inches cannot be achieved the deflection rate is slowed from the specified 0.5 inch/minute to a rate of 0.04 inches/minutes and the cross-section area of compression is reduced from 1 square inch to 0.125 square inches to reduce the effect of sample thickness variation and curl. Additional capacitance sensors can be added to more accurately measure the strain at a given stress. Effective modulus as measured according to this method can be at least 0.1, at least 1, at least 5, at least 10, at least 20, at least 40, at least 50, at least 70, or at least 100 megaPascals (MPa) up to 5, or up to 1 gigaPascals (GPa), or up to 700, up to 500, up to 300 MPa.

The separated supports and the void can enable efficient displacement of the fluid between the wafer and the protruding structure, thus reducing the time to contact between the pad and the substrate to be polished. This can increase the time the polishing surface is in contact with the wafer and/or increase the number of polishing protrusions in contact, either of which can potentially produce higher removal rates (higher asperity contact efficiencies and reduced defectivity (reduced individual asperity contact pressure). The voids can deform during polishing. At least a portion of the voids can remain during polishing.

The method of polishing a substrates as disclosed herein uses a pad having a base pad with a plurality of polishing elements, each polishing element being connected to the top surface of the base pad to the polishing element by three or more supports wherein the bottom surface of the polishing element, the top surface of the base pad and the supports define a region comprising at least one void. The method can include use of a slurry.

The substrate can be any substrate where polishing and/or planarization is desired. Examples of such substrates include magnetic, optical and semiconductor substrates. The method made be part front end of line or back end of line processing for integrated circuits. For example, the process can be used to remove undesired surface topography and surface defects, such as rough surfaces, agglomerated materials, crystal lattice damage, scratches and contaminated layers or materials. In addition, in damascene processes a material is deposited to fill recessed areas created by one or more steps of photolithography, patterned etching, and metallization. Certain steps can be imprecise—e.g. there can be overfilling of recesses. The method disclosed here can be used to remove material outside the recesses. The process can be chemical mechanical planarization or chemical mechanical polishing both of which can be referred to as CMP. A carrier can hold the substrate to be polished—e.g. a semiconductor wafer (with or without layers formed by lithography and metallization) in contact with the polishing elements of the polishing pad. A slurry or other polishing medium can be dispensed into a gap between the substrate and the polishing pad. The polishing pad and substrate are moved relative to one another—e.g. rotated. The polishing pad is typically located below the substrate to be polished. The polishing pad can rotate. The substrate to be polished can also be moved—e.g. on a polishing track such as an annular shape. The relative movement causes the polishing pad to approach and contact the surface of the substrate.

For example, the method can comprise: providing a chemical mechanical polishing apparatus having a platen or carrier assembly; providing at least one substrate to be polished; providing a chemical mechanical polishing pad as disclosed herein; installing onto the platen the chemical mechanical polishing pad; optionally, providing a polishing medium (e.g. slurry and/or non-abrasive containing reactive liquid composition) at an interface between a polishing portion of the chemical mechanical polishing pad and the substrate; creating dynamic contact between the polishing portion of the polishing pad and the substrate, wherein at least some material is removed from the substrate. The carrier assembly can provide a controllable pressure between the substrate being polished (e.g. wafer) and the polishing pad. The polishing medium can be dispensed onto the polishing pad and drawn into the gap between the wafer and polishing layer. The polishing medium can comprise water, a pH adjusting agent, and optionally one or more of, but not limited to, the following: an abrasive particle, an oxidizing agent, an inhibitor, a biocide, soluble polymers, and salts. The abrasive particle can be an oxide, metal, ceramic, or other suitably hard material. Typical abrasive particles are colloidal silica, fumed silica, ceria, and alumina. The polishing pad and substrate can rotate relative to one another. As the polishing pad rotates beneath the substrate, the substrate can sweep out a typically annular polishing track, or polishing region, wherein the wafer's surface directly confronts the polishing portion of the polishing pad. The wafer surface is polished and made planar by chemical and mechanical action of the polishing layer and polishing medium on the surface. Optionally, the polishing surface of the polishing pad can be conditioned with an abrasive conditioner before beginning polishing. Optionally the method of the present invention, the chemical mechanical polishing apparatus provided further includes a light source and a photosensor (preferably a multisensor spectrograph); and, the chemical mechanical polishing pad provided further includes an endpoint detection window; and, the method further comprises: determining a polishing endpoint by transmitting light from the light source through the endpoint detection window and analyzing the light reflected off the surface of the substrate back through the endpoint detection window incident upon the photosensor. The substrate can have a metal or metallized surface, such as one containing copper or tungsten. The substrate can be a magnetic substrate, an optical substrate and a semiconductor substrate.

The polishing pad disclosed here has a based pad. The base pad or base layer can be a single layer or can comprise more than one layer. The top surface of the base pad can define a plane, in the x-y Cartesian coordinates. The base may be provided on a subpad. For example, the base layer may be attached to a subpad via mechanical fasteners or by an adhesive. The subpad can be made from any suitable material, including for examples the materials useful in the base layer. The base layer in some aspects can have a thickness of at least 0.5, or at least 1 millimeters (mm). The base layer in some aspects can have a thickness of no more than 5, no more than 3, or no more than 2 mm. The base layer can be provided in any shape but it can be convenient to have a circular or disc shape with a diameter in the range of at least 10, at least 20, at least 30, at least 40, or at least 50 centimeters (cm) up to 100, up to 90, or up to 80 cm.

The base pad or base layer may comprise any material known for use as base layers for polishing pads. For example it can comprise a polymer, a composite of a polymeric material with other materials, ceramic, glass, metal, stone or wood. Polymers and polymer composites can be used as the base pad, particularly for the top layer if there is more than one layer, due to compatibility with the material that can form the protruding structures. Examples of such composites include polymers filled with carbon or inorganic fillers and fibrous mats of, for example glass or carbon fibers, impregnated with a polymer. The material of the base pad can have one or more of the following properties: a Young's modulus as determined, for example, by ASTMD412-16 in the range of at least 2, at least 2.5, at least 5, at least 10, or at least 50 megaPascals (MPa) up to 900, up to 700, up to 600, up to 500, up to 400, up to 300, or up to 200 MPa; a density of at least 0.4 or at least 0.5 up to 1.7, up to 1.5, or up to 1.3 grams per cubic centimeter (g/cm3). The material of the base pad can have a compressive modulus according to ASTM D3574 of at least 2, at least 2.5, at least 5, at least 10, or at least 50 megaPascals (MPa) up to 900, up to 700, up to 600, up to 500, up to 400, up to 300, or up to 200 MPa.

Examples of such polymeric materials that can be used in the base pad include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof.

The polymer can be a polyurethane. The polyurethane can be used alone or can be a matrix for carbon or inorganic fillers and fibrous mats of, for example, glass or carbon fibers. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof. The CMP polishing pads in accordance may be made by methods comprising: providing the isocyanate terminated urethane prepolymer; providing separately the curative component; and combining the isocyanate terminated urethane prepolymer and the curative component to form a combination, then allowing the combination to react to form a product. It is possible to form the base pad or base layer by skiving a cast polyurethane cake to a desired thickness. Optionally, preheating a cake mold with IR radiation, induction or direct electrical current can reduce product variability when casting porous polyurethane matrices. Optionally, it is possible to use either thermoplastic or thermoset polymers. The polymer can be a crosslinked thermoset polymer.

The pad further includes a plurality of polishing elements connected to the top surface of the base pad by three or more supports.

Figure 5:
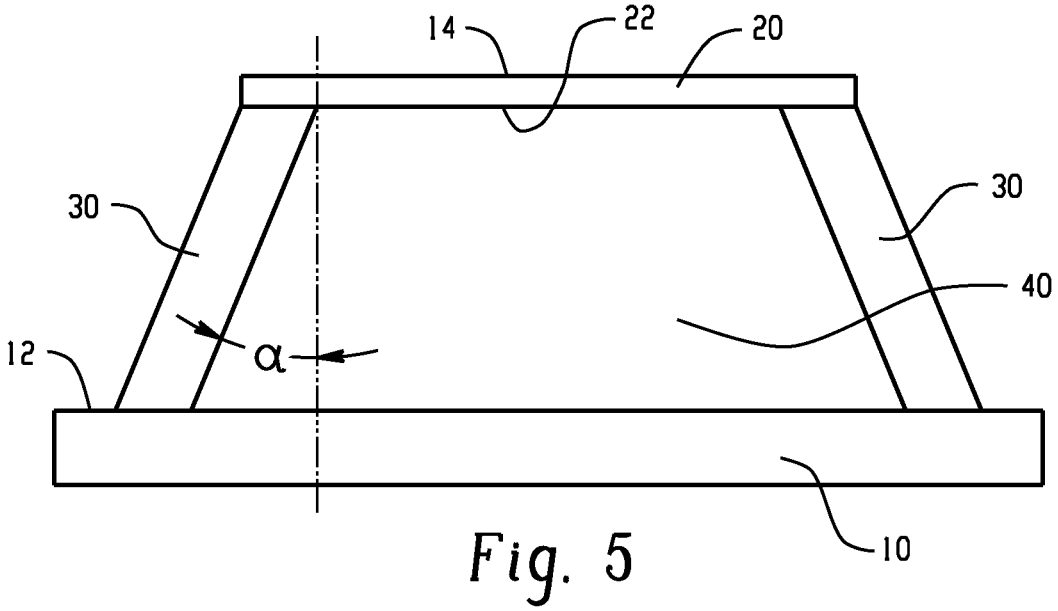
FIG. 5 is drawing is a side view showing a base pad with a polishing element on supports as can be used in the pad of this invention.
Figure 6:
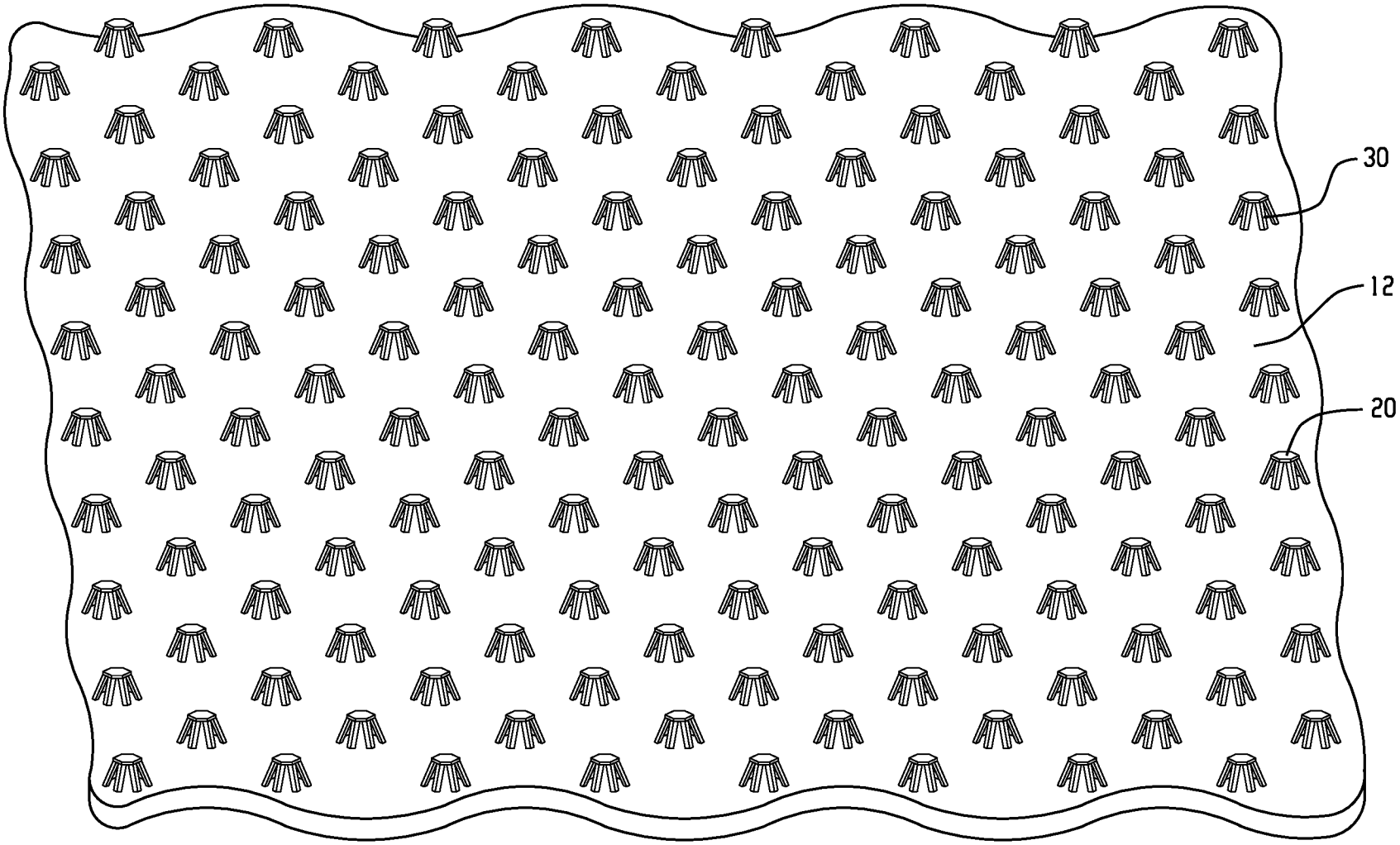
FIG. 6 is a drawing of showing a portion of an example of a pad having discrete polishing elements connected to a base pad by supports as in an aspect of this invention.

For example, as shown in FIG. 5, the polishing element 20, having a top surface 14 and a bottom surface 22, can be connected to the top surface 12 of the base pad 10 by supports 30. Advantageously, polishing elements 20 have top surface 14 parallel to the top surface of the base pad. Most advantageously, polishing elements 20 have bottom surface (not seen) parallel to the top surface of the base pad and top surface 14. In the side view of FIG. 5, two supports 30 are shown out of a total of four supports for the polishing element 30. The supports 30 and the top of the base pad 12 of the base pad 10, and the bottom 22 of the polishing element 20 define a void region 40. The polishing elements can be at a distance of at least 0.05, or at least 0.1, mm from the top surface 12 of the base pad 10, when measured from top surface 12 of the base pad 10 to bottom surface 22 of the polishing element 20. The polishing elements can be at a distance of less than less than 3 mm, less than 2.5 mm, less than 2 mm, less than 1.5, less than 1, or less than 0.8 mm when measured from the top 12 of the base pad 10 to the bottom 22 of the polishing element 20. In FIG. 6, a view of the top surface of a polishing is shown where there are six supports 30 for each polishing element 20 connecting the top surface 12 of the base pad to the polishing element 30.

The polishing element can have a regular or irregular shape. For example, the polishing element could have a top surface 14 that is circular, oval polygonal, parabolic or the like.

The polishing element has a top surface 14 that is the initial polishing surface area (i.e. initial contact area). As it is used the surface will be worn down exposing a subsequent polishing surface area. The subsequent polishing surface area can be the same as the initial polishing surface area or can differ from the initial polishing surface area by less than 25, less than 20, less than 15, less than 10, or less than 5%. A polishing element can have a constant cross section over the entire height of the polishing element or the cross section may vary over the height of a polishing element. The sum of the cross sections of the multitude of polishing elements can be substantially constant such as to provide a consistent area of contact as the structures are worn down during use. Thus if one or more of the polishing element is narrower at the top, others of the polishing elements can be broader at the top leading to a constant total area of cross section. The top surface of the polishing element (or top polishing surface) is substantially planar. This planar surface facilitates increased polishing contact with wafer substrates. The polishing element can have a thickness and a cross sectional dimension that are separate from and not defined by the supports. By substantially planar it is meant that while there may be texture (microtexture) and there may be voids or openings in the surface, the periphery of the polishing element defines a plane and the top surface contacts or is below that plane. The top surface can be parallel to a plane defined by the base pad. Advantageously, top surface 14 has sufficient surface area to allow formation of a microtexture with a diamond abrasive disk or other abrasive.

A cross-section area of a polishing element in the x-y plane (e.g. the polishing surface area—initial and/or subsequent) can be in the range at least 0.05, at least 0.1, or at least square millimeters (mm2) and can be up to 30, up to 25, up to 20, up to 15, up to 10, up to 5, up to 3, up to 2 mm2. The longest distance of the polishing element in the x-y plane (e.g. the longest distance a fluid would travel across the top surface of a polishing element) can be at least or at least 0.5 millimeters (mm). The longest distance of the polishing element in the x-y plane (e.g. the longest distance a fluid would travel across the top surface of a protruding structure) can be up to 1000, up to 800, up to 100, up to 50, up to 20, up to 10, up to 5, up to 3, up to 2, or up to 1 mm, up to 0.8 mm.

The thickness of the polishing element can at least 0.1, at least 0.2, at least 0.5, or at least 1 mm. The thickness of the polishing element can be up to 2.5, up to 2, up to 1.5, up to 1, or up to 0.8 mm.

Figure 2:
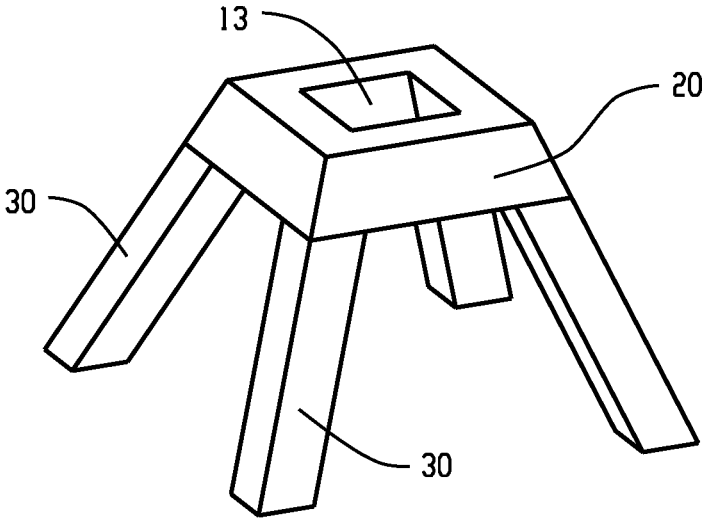
FIG. 2 is drawing of an example of a polishing element and supports as can be used in the pad of this invention.
Figure 3:
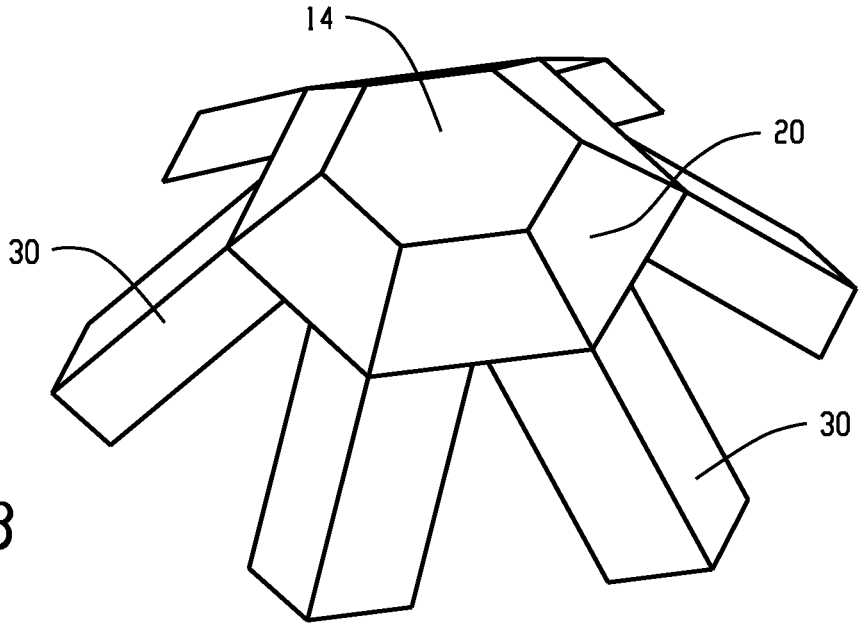
FIG. 3 is drawing of an example of a polishing element and supports as can be used in the pad of this invention.

The polishing element can present a solid surface or can have an opening 13 as shown in FIG. 2.

The polishing element can comprise any material useful as a polishing material in a polishing pad. The polishing element can be of the same or different material from that used in the base pad. For example, it can comprise a polymer, a composite of a polymeric material with other materials, ceramic, glass, metal, stone or wood. Examples of such composites include polymers filled with carbon or inorganic fillers and fibrous mats of, for example glass or carbon fibers, impregnated with a polymer. The material of the polishing element have one or more of the following properties: a Young's modulus as determined, for example, by ASTMD412-16 in the range of at least 10, at least 50, or at least 100 MPa up to 10, up to 5, or up to 1 gigaPascals (GPa), or up to 900, up to 800, up to 700, up to 600, up to 500, up to 400, or up to 300 MPa. A Poisson's ratio as determined, for example, by ASTM E132015 of at least 0.05, at least 0.08, or at least 0.1 up to 0.6 or up to 0.5; a density of at least 0.4 or at least 0.5 up to 1.7, up to 1.5, or up to 1.3 g/cm3. The material of the polishing element can have a compressive modulus according to ASTM D3574 in the range of least 10, at least 50, or at least 100 MPa up to 10, up to 5, or up to 1 gigaPascals (GPa), or up to 900, up to 800, up to 700, up to 600, up to 500, up to 400, or up to 300 MPa.

Examples of such polymeric materials that can be used in the polishing element include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof.

The polymer can be a polyurethane. The polyurethane can be used alone or can be a matrix for carbon or inorganic fillers and fibrous mats of, for example, glass or carbon fibers. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof. The CMP polishing pads in accordance may be made by methods comprising: providing the isocyanate terminated urethane prepolymer; providing separately the curative component; and combining the isocyanate terminated urethane prepolymer and the curative component to form a combination, then allowing the combination to react to form a product. It is possible to use either thermoplastic or thermoset polymers. The polymer can be a crosslinked thermoset polymer.

The polishing elements are connected to the base pad by three or more supports. The supports are spaced apart from each other where they contact the polishing element such that the supports do not contact each other. The distance between the supports at the polishing element can be at least 2%, at least 5%, at least 10%, or at least 20% up to 50%, up to 40%, or up to 30% the longest dimension of the polishing element (in the x-y direction). The distance between the supports at the polishing element depends upon the size of the cross section of the polishing element but at the polishing element can be at least 0.02, at least 0.05, at least 0.08, at least 0.1, at least 0.2, at least 0.3 mm and can be up to 10, up to 5, up to 3, up to 1, up to 0.8, up to 0.5, up to 0.4 mm. The three or more supports can be connected at or near the periphery of the polishing element. Optionally, one or more additional supports may be located inward from the periphery of the polishing element. For example, a polishing element could have 3 or four supports at or near the edges of the polishing element extending from the bottom side or edge of the polishing element. The polishing element could have an additional support located inward from the periphery or edges of the polishing element—e.g. a center support. The supports can be adhered to the base pad or can be integral to the base pad. The supports can be adhered to the polishing element or can be integral to the polishing element. For example, the polishing element, the supports and a top layer of a base pad can be integral to each other—e.g. formed of the same material with no adhesive interface between the materials.

The polishing elements can be connected directly to the base pad by the supports, without any intervening layers. In other words, there can be a single layer of supports.

The supports can comprise any material useful in polishing pads. The supports can be of the same or different material from that used in the base pad. The supports can be of the same or different material from that used in the polishing elements. For example, it can comprise a polymer, a composite of a polymeric material with other materials, ceramic, glass, metal, stone or wood. Examples of such composites include polymers filled with carbon or inorganic fillers and fibrous mats of, for example glass or carbon fibers, impregnated with a polymer. The material of the support can have one or more of the following properties: a Young's modulus as determined, for example, by ASTMD412-16 in the range of at least 10, at least 50, or at least 100 MPa up to 10, up to 5, or up to 1 gigaPascals (GPa), or up to 900, up to 800, up to 700, up to 600, up to 500, up to 400, or up to 300 MPa. A Poisson's ratio as determined, for example, by ASTM E132015 of at least 0.05, at least 0.08, or at least 0.1 up to or up to 0.5; a density of at least 0.4 or at least 0.5 up to 1.7, up to 1.5, or up to 1.3 g/cm3. The material of the support can have a compressive modulus according to ASTM D3574 in the range of least 10, at least 50, or at least 100 MPa up to 10, up to 5, or up to 1 gigaPascals (GPa), or up to 900, up to 800, up to 700, up to 600, up to 500, up to 400, or up to 300 MPa.

Examples of such polymeric materials that can be used in the polishing element include polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and combinations or blends thereof.

The polymer can be a polyurethane. The polyurethane can be used alone or can be a matrix for carbon or inorganic fillers and fibrous mats of, for example glass or carbon fibers, For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof. The CMP polishing pads in accordance may be made by methods comprising: providing the isocyanate terminated urethane prepolymer; providing separately the curative component; and combining the isocyanate terminated urethane prepolymer and the curative component to form a combination, then allowing the combination to react to form a product. It is possible to use either thermoplastic or thermoset polymers. The polymer can be a crosslinked thermoset polymer.

The supports can have any shape in cross section—e.g. circle, oval, rectangle, polygon, parametric. The supports can be solid or can have a void or voids—e.g. could be substantially cylindrical. The supports can be perpendicular to the polishing element, perpendicular to the base pad, or both. The supports can be project outward from a periphery of the polishing element and down toward the base pad. As shown in FIGS. 1-6, the supports can extend from at or near the periphery of the polishing element to the surface of the base pad at an angle. Alternatively, the support can project inward from a periphery of the polishing element such that they are below the bottom surface of the polishing element. The supports for a polishing element can be arranged such that they do not contact each other, particularly, the supports for a polishing element do not contact each other where they contact the base pad. The furthest distance from one support to another support for the same polishing element where it contacts the base pad can be the same or larger than the distance between those supports where they contact the polishing element. The furthest distance from one support to another support for the same polishing element where the supports contact that base pad can be at least 10, at least 20, at least 50, at least 100% up to 3500%, up to 2500% up to 1000%, up to 500%, up to 400%, up to 300%, or up to 200% longer than the longest distance of the polishing element in the x-y plane. The furthest distance from one support to another support for the same polishing element where the supports contact that base pad can be can be at least 0.1, or at least 0.5 mm up to 100, up to 50, up to 20, up to 10, up to 5, up to 3, up to 2, or up to 1 mm.

The height of the supports (distance from the top surface of the base pad to the bottom surface of the polishing element) can be at least 0.05, at least 0.1, at least 0.2 and can be up to 3, up to 2, up to 1, up to 0.8, or up to 0.5 mm. The cross section of a support element in the x-y plane can be at least 0.02, at least 0.05, or at least 0.1 mm2 and can be up to 2, up to 1, or up to 0.5 mm2.

For supports that are substantially straight, an angle, a, from perpendicular to the polishing element, as seen in FIG. 5 between the support 30 and the polishing element 20 can be in the range from 0, or at least 10, or at least 20 up to 60, up to 50, up to 45, or up to 40 degrees.

Figure 4:
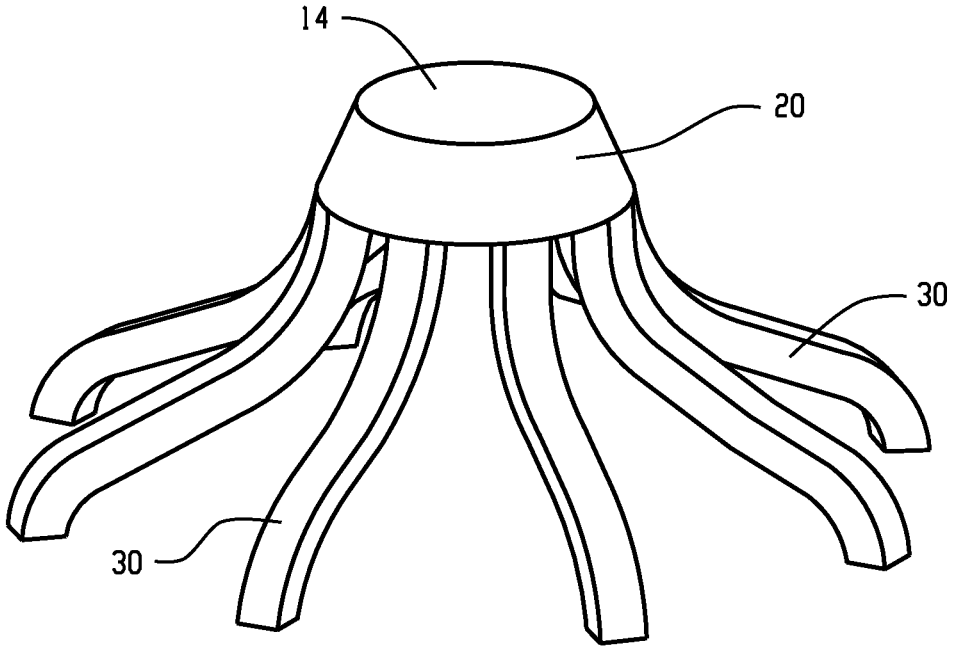
FIG. 4 is drawing of an example of a polishing element and supports as can be used in the pad of this invention.

FIG. 4 shows supports having a curved supports 30 that extend in the x-y direction beyond the perimeter of the polishing element 20, for example by at least 20, at least 50, or at least 100% up to 400, or up to 300% based on distance across the polishing element. These shapes can be spider-like, can be defined by a parametric formula. Alternatively, the supports could have two or more straight segments.

Supports of polishing elements can be separated from supports for an adjacent polishing elements where they contact the base pad. The separation distance can be at least 0.01, at least 0.02 mm up to 40, up to 30, up to 20, up to 10, up to 5, up to 2, or up to 1 mm.

Supports of polishing elements can optionally contact from supports for adjacent polishing elements where they contact the base pad. Advantageously, supports for polishing elements are independent of and do not contact supports from all adjacent polishing elements.

When a polyurethane is used in the base pad and/or the protruding structure it can be the reaction product of a polyfunctional isocayante and a polyol. For example a polyisocyante terminated urethane prepolymer can be used. The polyfunctional isocyanate used in the formation of the polishing layer of the chemical mechanical polishing pad of the present invention can be selected from the group consisting of an aliphatic polyfunctional isocyanate, an aromatic polyfunctional isocyanate and a mixture thereof. For example, the polyfunctional isocyanate used in the formation of the polishing layer of the chemical mechanical polishing pad of the present invention can be a diisocyanate selected from the group consisting of 2,4-toluene diisocyanate; 2,6-toluene diisocyanate; 4,4'-diphenylmethane diisocyanate; naphthalene-1,5-diisocyanate; tolidine diisocyanate; para-phenylene diisocyanate; xylylene diisocyanate; isophorone diisocyanate; hexamethylene diisocyanate; 4,4'-dicyclohexylmethane diisocyanate; cyclohexanediisocyanate; and, mixtures thereof. The polyfunctional isocyanate can be an isocyanate terminated urethane prepolymer formed by the reaction of a diisocyanate with a prepolymer polyol. The isocyanate-terminated urethane prepolymer can have 2 to 12 wt %, 2 to 10 wt %, 4 to 8 wt % or 5 to 7 wt % unreacted isocyanate (NCO) groups. The prepolymer polyol used to form the polyfunctional isocyanate terminated urethane prepolymer can be selected from the group consisting of diols, polyols, polyol diols, copolymers thereof and mixtures thereof. For example, the prepolymer polyol can be selected from the group consisting of polyether polyols (e.g., poly(oxytetramethylene)glycol, poly(oxypropylene)glycol and mixtures thereof); polycarbonate polyols; polyester polyols; polycaprolactone polyols; mixtures thereof and, mixtures thereof with one or more low molecular weight polyols selected from the group consisting of ethylene glycol; 1,2-propylene glycol; 1,3-propylene glycol; 1,2-butanediol; 1,3-butanediol; 2-methyl-1,3-propanediol;

1,4-butanediol; neopentyl glycol; 1,5-pentanediol; 3-methyl-1,5-pentanediol; 1,6-hexanediol; diethylene glycol; dipropylene glycol; and, tripropylene glycol. For example, the prepolymer polyol can be selected from the group consisting of polytetramethylene ether glycol (PTMEG); ester based polyols (such as ethylene adipates, butylene adipates); polypropylene ether glycols (PPG); polycaprolactone polyols; copolymers thereof; and, mixtures thereof. For example, the prepolymer polyol can be selected from the group consisting of PTMEG and PPG. When the prepolymer polyol is PTMEG, the isocyanate terminated urethane prepolymer can have an unreacted isocyanate (NCO) concentration of 2 to 10 wt % (more preferably of 4 to 8 wt %; most preferably 6 to 7 wt %). Examples of commercially available PTMEG based isocyanate terminated urethane prepolymers include Imuthane® prepolymers (available from COIM USA, Inc., such as, PET-80A, PET-85A, PET-90A, PET-93A, PET-95A, PET-60D, PET-70D, PET-75D); Adiprene® prepolymers (available from Chemtura, such as, LF 800A, LF 900A, LF 910A, LF 930A, LF 931A, LF 939A, LF 950A, LF 952A, LF 600D, LF 601D, LF 650D, LF 667, LF 700D, LF750D, LF751D, LF752D, LF753D and L325); Andur® prepolymers (available from Anderson Development Company, such as, 70APLF, 80APLF, 85APLF, 90APLF, 95APLF, 60DPLF, 70APLF, When the prepolymer polyol is PPG, the isocyanate terminated urethane prepolymer can have an unreacted isocyanate (NCO) concentration of 3 to 9 wt % (more preferably 4 to 8 wt %, most preferably 5 to 6 wt %). Examples of commercially available PPG based isocyanate terminated urethane prepolymers include Imuthane® prepolymers (available from COIM USA, Inc., such as, PPT-80A, PPT-90A, PPT-95A, PPT-65D, PPT-75D); Adiprene® prepolymers (available from Chemtura, such as, LFG 963A, LFG 964A, LFG 740D); and, Andur® prepolymers (available from Anderson Development Company, such as, 8000APLF, 9500APLF, 6500DPLF, 7501DPLF). The isocyanate terminated urethane prepolymer can be a low free isocyanate terminated urethane prepolymer having less than 0.1 wt % free toluene diisocyanate (TDI) monomer content. Non-TDI based isocyanate terminated urethane prepolymers can also be used. For example, isocyanate terminated urethane prepolymers include those formed by the reaction of 4,4'-diphenylmethane diisocyanate (MDI) and polyols such as polytetramethylene glycol (PTMEG) with optional diols such as 1,4-butanediol (BDO) are acceptable. When such isocyanate terminated urethane prepolymers are used, the unreacted isocyanate (NCO) concentration is preferably 4 to 10 wt % (more preferably 4 to 10 wt %, most preferably 5 to 10 wt %). Examples of commercially available isocyanate terminated urethane prepolymers in this category include Imuthane® prepolymers (available from COIM USA, Inc. such as 27-85A, 27-90A, 27-95A); Andur® prepolymers (available from Anderson Development Company, such as, IE75AP, IE80AP, IE 85AP, IE90AP, IE95AP, IE98AP); and, Vibrathane® prepolymers (available from Chemtura, such as, B625, B635, B821).

The polishing elements with their supports can be arranged in any configuration on the base pad. For example, they can be arranged in a hexagonal packing structure oriented in the same direction. As another example, they can be arranged in a radial pattern oriented such that one lobe aligns with the radial. The polishing elements can be spaced at a distance from center of one polishing element to center of an adjacent polishing element, i.e. a pitch, at least 1.5, or at least 2 up to 50, up to 20, up to 10, up to 7, up to 5, or up to 4 times a longest dimension of the cross section of the polishing element. For example, the pitch can be at least at least 1, at least 5, or at least 10, up to 100 mm, up to 50 mm, or up to 20 mm. The distance from the perimeter of one polishing element to a nearest perimeter of an adjacent polishing element can be as least 0.02, at least 0.05, at least 0.1, at least 0.5, or at least 1 mm up to 40, up to 30, up to 20, up to 10, or up to 5 mm.

The contact area ratio is cumulative surface contact area (i.e. polishing surface area of all polishing elements on the pad), Acpsa, of the plurality of polishing elements divided by the area of the base, Ab. According to certain embodiments ratio of Acpsa/Ab is at least 0.1 or 0.2 or 0.3 or 0.4 and is no more than 0.8 or 0.75 or 0.7 or 0.65 or 0.6. Stated alternatively the top polishing surfaces of the plurality of polishing elements cumulatively have an area of defines have an area of at least 10, at least 20, at least 30 or at least 40 up to 80, up to 75, up to 70, up to or up to 60% of the area of the base.

The pad may be made by any suitable process. For example, the pad may be made by additive manufacturing by known method and the supports and polishing elements are built up on a provided base of the pad by such additive manufacturing or the entire pad could be made by additive manufacturing.

Figure 7:
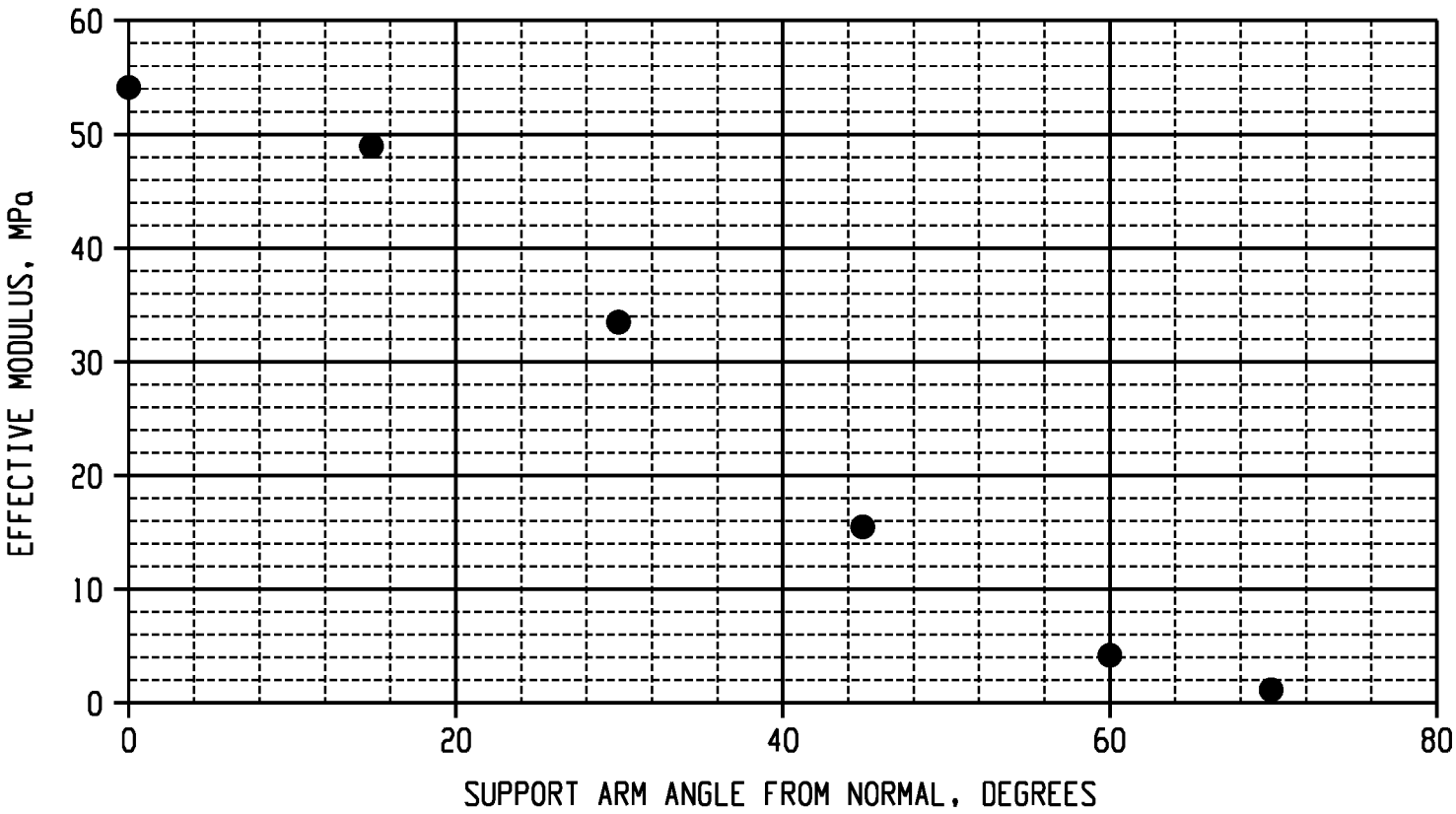
FIG. 7 is a graph showing the effect of angle, a, of supports on effective compressive modulus.

FIG. 7 shows the effective modulus of a pad having a square polishing element having a side length of 1 mm and a thickness of 0.25 mm versus the angle of the support. The structures have 4 support arms with a square cross section of 0.25 mm side length. The distance from the top of the base to the bottom of the polishing element is 1 mm. A pressure of 24 pounds per square inch/element (0.16 MPa) reveals an effective modulus as shown in FIG. 7. The material used for the polishing element and the supports has a bulk modulus of 200 MPa.

This demonstrates that the modulus of the pad can be reduced to improve conformity of the pad to the surface being polished while still using polishing materials in the polishing element that have good polishing effect.

This disclosure further encompasses the following aspects.

Aspect 1: A polishing pad useful in chemical mechanical polishing comprising a base pad having a top surface and surface, a plurality of polishing elements each having a top polishing surface and a bottom surface, and wherein each of the plurality of polishing elements is connected to the top surface of the base pad to the polishing element by three or more supports wherein the supports are spaced apart from each other at the polishing element and at the base pad, and wherein the bottom surface of the polishing element, the top surface of the base pad and the supports define a region comprising at least one void and there are openings between the three or more supports.

Aspect 2: The polishing pad of aspect 1 wherein the at least three supports extend from a peripheral region of the polishing element to the top surface of the base pad and further comprising a center support extending from the bottom surface of the polishing element to the top surface of the base pad.

Aspect 3: The polishing pad of aspects 1 or 2 wherein the top polishing surface of each of the plurality of polishing elements define a plane.

Aspect 4: The pad of any of the previous aspects wherein the top polishing surface of each of the plurality of polishing elements is planar or substantially planar.

Aspect 5: The pad of any of the previous aspects wherein the top polishing surface of each of the polishing elements is textured.

Aspect 6: The polishing pad of any of the previous aspects wherein the base pad, the plurality of discrete polishing elements and the supports are integral to each other.

Aspect 7: The polishing pad of any of the previous aspects wherein the polishing elements comprise a first composition and the base pad comprises a second composition and the first and second composition are different.

Aspect 8: The polishing pad of any of the previous aspects wherein the top polishing surfaces of the plurality of polishing elements cumulatively have an area of defines an area of least 10, at least 20, at least 30 or at least 40 up to 80, up to 75, up to 70, up to 65 or up to 60%.

Aspect 9: The polishing pad of any of the previous aspects where the at least three supports are at or near a peripheral edge of the polishing element at an angle of 0 to 60, preferably 10 to 50, more preferably 15 to 45 degrees relative to perpendicular from the base of the polishing element.

Aspect 10: The polishing pad of any of the previous aspects wherein the supports are straight or curved and project outside of a peripheral edge of the polishing element.

Aspect 11: The polishing pad of any of the preceding aspects having an effective compressive modulus of at least 10%, preferably at least 20%, up to 90%, preferably up to 70%, more preferably up to 50% of the modulus of the compressive modulus of the material used in the polishing element.

Aspect 12: The polishing pad of any of the preceding aspects having an effective compressive modulus of at least 0.1, at least 1, at least 5, at least 10, at least 20, at least 40, at least 50, at least 70, or at least 100 megaPascals (MPa) up to 5, or up to 1 gigaPascals (GPa), or up to 700, up to 500, up to 300 MPa.

Aspect 13: The polishing pad of any of the preceding aspects a distance from the top surface of the base pad to the bottom surface of the polishing element is 0.1 to 2 mm, preferably 0.2 to 1.5 mm.

Aspect 14: The polishing pad of any of the preceding aspects wherein the polishing element has a thickness and a cross section that are independent of the supports.

Aspect 15: The polishing pad of any of the preceding aspects wherein where they contact the polishing element the supports are at a distance from each other of from 5 to 40%, preferably 10 to 30%, of a longest dimension of the polishing element (in the x-y plane).

Aspect 16: The polishing pad of any of the preceding aspects where the supports do not contact each other.

Aspect 17: A method comprising providing a substrate, and polishing the substrate using the polishing pad of any one of aspects 1 to 16.

Aspect 18: The method of aspect 17 where the void remains during polishing.

Aspect 19: The method of aspect 17 or 18 wherein a polishing medium is provided on the polishing pad.

Aspect 20: The method of any one of aspects 17-9 wherein during polishing the top polishing surface is worn down exposing a subsequent polishing surface and wherein an area of the subsequent polishing surface area differs from an area of the top polishing surface area by less than 25%, preferably less than 20%, more preferably less than 15%, still more preferably less than 10%, and most preferably less than 5%.

The compositions, methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). Moreover, stated upper and lower limits can be combined to form ranges (e.g. "at least 1 or at least 2 weight percent" and "up to 10 or 5 weight percent" can be combined as the ranges "1 to 10 weight percent", or "1 to 5 weight percent" or "2 to 10 weight percent" or "2 to 5 weight percent"). "Combinations" is inclusive of blends, mixtures, alloys, reaction products, and the like. The terms "first," "second," and the like, do not denote any order, quantity, or importance, but rather are used to distinguish one element from another. The terms "a" and "an" and "the" do not denote a limitation of quantity and are to be construed to cover both the singular and the plural, unless otherwise indicated herein or clearly contradicted by context. "Or" means "and/or" unless clearly stated otherwise. Reference throughout the specification to "some embodiments", "an embodiment", and so forth, means that a particular element described in connection with the embodiment is included in at least one embodiment described herein, and may or may not be present in other embodiments. In addition, it is to be understood that the described elements may be combined in any suitable manner in the various embodiments. A "combination thereof" is open and includes any combination comprising at least one of the listed components or properties optionally together with a like or equivalent component or property not listed.

Unless specified to the contrary herein, all test standards are the most recent standard in effect as of the filing date of this application, or, if priority is claimed, the filing date of the earliest priority application in which the test standard appears.

What is claimed is:

1. A polishing pad useful in chemical mechanical polishing comprising:

a base pad having a top surface, a plurality of polishing elements each having a top polishing surface and a bottom surface, and wherein each of the plurality of polishing elements is connected to the top surface of the base pad to the polishing element by three or more straight supports wherein the straight supports are in a single layer and are spaced apart from each other at the polishing element and at the base pad, the three or more straight supports are at a peripheral edge of the polishing element and extend outward beyond the peripheral edge at an angle 10 to 50 degrees from perpendicular to the polishing element, and wherein the bottom surface of the polishing element, the top surface of the base pad and the straight supports define a region comprising at least one void and there are openings between the three or more straight supports.

2. The polishing pad of claim 1 wherein each polishing element has a thickness and a cross section that are independent of the straight supports and the top polishing surface of each polishing element defines a plane.

3. The polishing pad of claim 1, wherein the polishing pad has an effective compressive modulus 10 to 90% of the modulus of the compressive modulus of the material used in the polishing element, wherein the material used in the polishing element comprises polycarbonates, polysulfones, nylons, epoxy resins, polyethers, polyesters, polystyrenes, acrylic polymers, polymethyl methacrylates, polyvinylchlorides, polyvinyl fluorides, polyethylenes, polypropylenes, polybutadienes, polyethylene imines, polyurethanes, polyether sulfones, polyamides, polyether imides, polyketones, epoxies, silicones, copolymers thereof, and combinations or blends thereof.

4. The polishing pad of claim 1 wherein a distance between the top surface of the base pad and the bottom surface of the polishing element is 0.1 to 1.5 mm.

* * * * *